US010655926B2

(12) United States Patent
Young et al.

(10) Patent No.: US 10,655,926 B2
(45) Date of Patent: May 19, 2020

(54) FIREARM SOUND SUPPRESSOR HAVING FLASH HIDER

(71) Applicant: Smith & Wesson Corp., Springfield, MA (US)

(72) Inventors: Nolan Blake Young, Boise, ID (US); Jacob Fredrick Kunsky, Bruneau, ID (US)

(73) Assignee: Smith & Wesson Inc., Springfield, MA (US)

( * ) Notice: Subject to any disclaimer, the term of this patent is extended or adjusted under 35 U.S.C. 154(b) by 0 days.

(21) Appl. No.: 16/110,800

(22) Filed: Aug. 23, 2018

(65) Prior Publication Data

US 2020/0064099 A1 Feb. 27, 2020

(51) Int. Cl.

| | |
|---|---|
| ***F41A 21/30*** | (2006.01) |
| ***F41A 21/28*** | (2006.01) |
| ***F41A 21/32*** | (2006.01) |
| ***F41A 21/34*** | (2006.01) |

(52) U.S. Cl.

CPC ..... *F41A 21/30* (2013.01); *F41A 21/28* (2013.01); *F41A 21/325* (2013.01); *F41A 21/34* (2013.01)

(58) Field of Classification Search

CPC ..... F41A 21/28; F41A 21/30; F41A 21/34; F41A 21/325

USPC ..... 89/14.4

See application file for complete search history.

(56) References Cited

U.S. PATENT DOCUMENTS

| | | | | |
|---|---|---|---|---|
| 6,374,718 | B1 | 4/2002 | Rescigno et al. | |
| 8,015,908 | B2 * | 9/2011 | Kline | F41A 21/30 181/223 |
| 8,171,840 | B2 * | 5/2012 | Kline | F41A 21/30 181/223 |
| 8,342,071 | B2 * | 1/2013 | Hortobagyi | F41A 21/34 89/14.2 |
| 8,479,632 | B2 * | 7/2013 | Kline | F41A 21/30 181/223 |
| 8,490,534 | B1 * | 7/2013 | Moore | F41A 21/34 181/223 |
| 9,163,891 | B1 | 10/2015 | Dater et al. | |
| 9,377,263 | B1 * | 6/2016 | Sy | F41A 21/36 |
| 10,371,476 | B1 * | 8/2019 | Oglesby | F41A 21/30 |
| 2011/0186377 | A1 * | 8/2011 | Kline | F41A 21/30 181/223 |
| 2012/0048644 | A1 * | 3/2012 | Kline | F41A 21/30 181/223 |
| 2012/0279798 | A1 * | 11/2012 | Kline | F41A 21/30 181/223 |
| 2014/0262602 | A1 * | 9/2014 | Moss | F41A 21/30 181/211 |
| 2015/0308775 | A1 * | 10/2015 | Packard | F41A 21/34 89/14.2 |

* cited by examiner

*Primary Examiner* — Samir Abdosh
(74) *Attorney, Agent, or Firm* — Stinson LLP

(57) ABSTRACT

A firearm sound suppressor and associated methods. The sound suppressor includes a distal end wall and a flash hider on the distal end wall for reducing flash at an outlet of the suppressor. The sound suppressor can include a core including gas baffling integrally formed with the distal end wall and the flash hider. The flash hider can include a plurality of arms having slots therebetween and extending distally away from the distal end wall.

23 Claims, 9 Drawing Sheets

FIREARM SOUND SUPPRESSOR HAVING FLASH HIDER

FIELD

The present disclosure generally relates to firearm accessories, and more particularly to firearm muzzle accessories.

BACKGROUND

Firearm sound suppressors can be connected to a muzzle of a firearm to reduce sound emitted when a shot is fired from the firearm. When a shot is fired through the suppressor, a flash may be visible at a distal end of the suppressor. The flash can be caused by secondary combustion when the hot gas and/or products of combustion meet outside air at the outlet of the suppressor.

SUMMARY

In one aspect, a firearm sound suppressor includes a housing having a proximal end and a distal end opposite the proximal end. The firearm sound suppressor includes a core in the housing having a projectile passage through which a projectile can pass along a projectile axis. The core includes a frame and a plurality of baffles defining a tortuous gas flow path through the core. The frame is formed as one piece of material with the plurality of baffles. The core includes a distal end wall at a distal end of the firearm sound suppressor. The distal end wall is formed as one piece of material with the frame and the plurality of baffles. The core includes a flash hider supported by the distal end wall and extending distally from the distal end wall.

In another aspect, a firearm sound suppressor includes a firearm connector constructed for connecting the firearm sound suppressor to a firearm. A housing is supported by the firearm connector. The housing has a proximal end and a distal end opposite the proximal end. A projectile passage extends between the proximal and distal ends of the housing. A projectile can pass along a projectile axis through the projectile passage. Gas baffling is supported by the housing. The gas baffling forms a tortuous gas flow path inside the housing. A distal end wall at a distal end of the firearm sound suppressor has an opening through which the projectile passage extends. A flash hider is supported by the distal end wall. The flash hider includes a plurality of arms extending distally away from the distal end wall. The arms bound slots between the arms. The flash hider has a length extending parallel to the projectile axis from the distal end wall to a distal end of the flash hider. Each slot has a length extending parallel to the projectile axis from a proximal end of the slot to a distal end of the slot. The lengths of the slots being at least one quarter of the length of the flash hider.

Other objects and features of the present disclosure will be in part apparent and in part pointed out herein.

BRIEF DESCRIPTION OF THE DRAWINGS

Corresponding reference characters indicate corresponding parts throughout the drawings.

DETAILED DESCRIPTION

Figure 1:
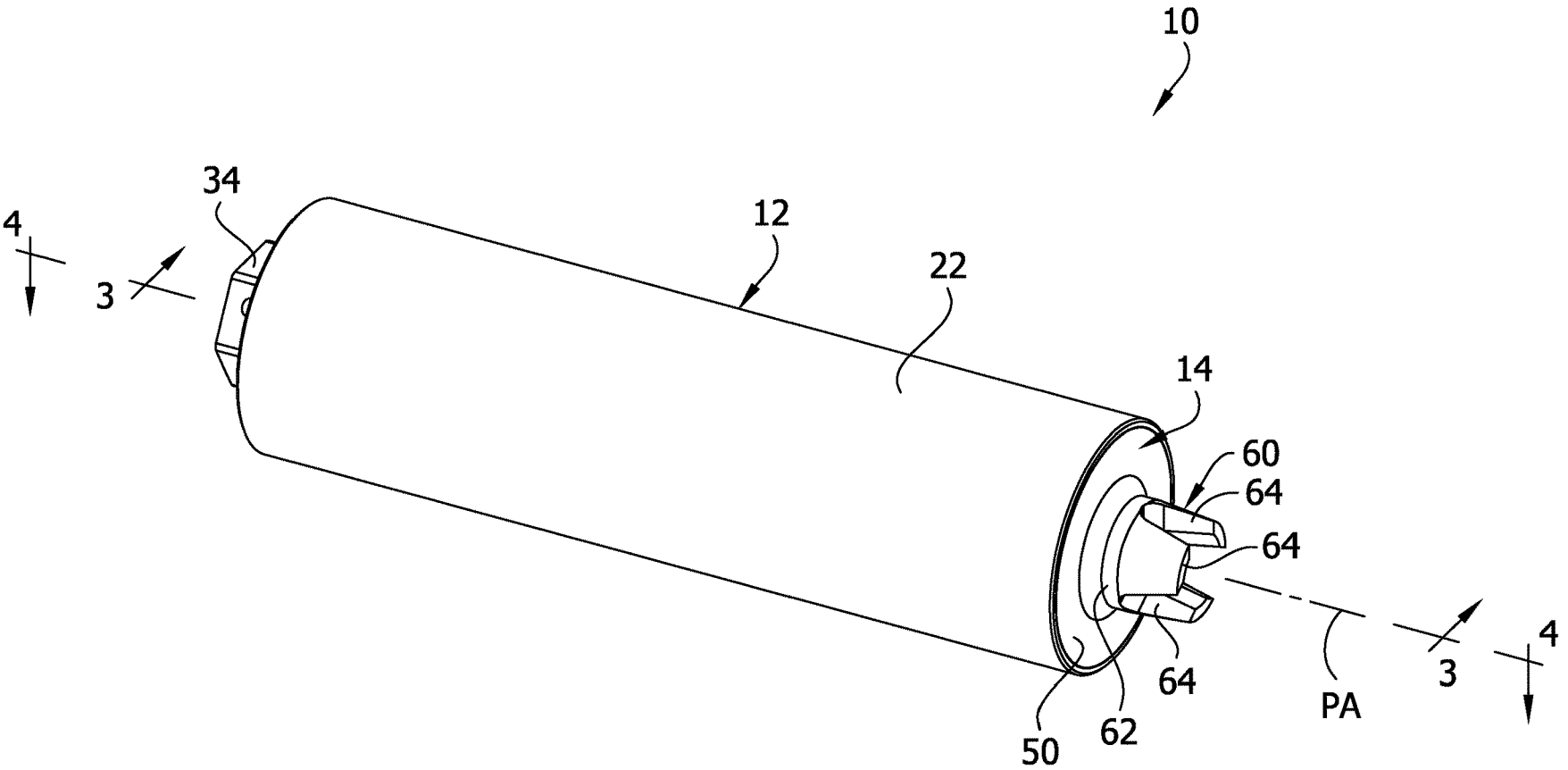
FIG. 1 is a perspective of a firearm sound suppressor of the present disclosure.
Figure 2:
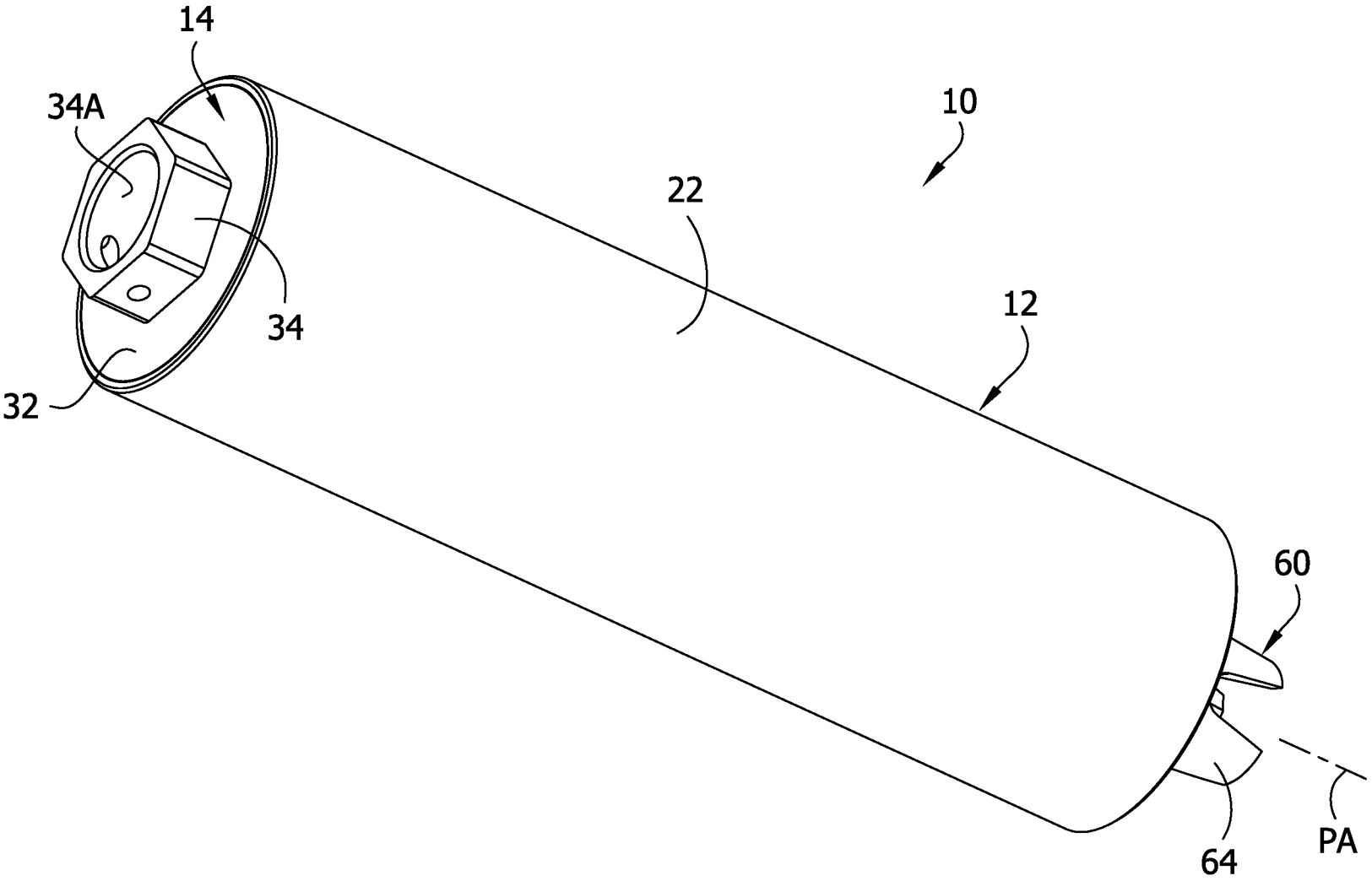
FIG. 2 is another perspective of the firearm sound suppressor.

Referring to FIGS. 1 and 2, a firearm sound suppressor (broadly, "firearm muzzle accessory") of the present disclosure is designated generally by the reference number 10. The suppressor is configured to be mounted on a firearm. A projectile (e.g., bullet) can be fired from the firearm through a projectile passage 11 (FIG. 3) of the suppressor extending along a projectile axis PA. The suppressor 10 is configured to reduce sound heard when the firearm is fired by reducing pressure and/or velocity of propellant gases from a muzzle of the firearm before the gases are emitted to the surrounding environment from the suppressor.

Figure 3:
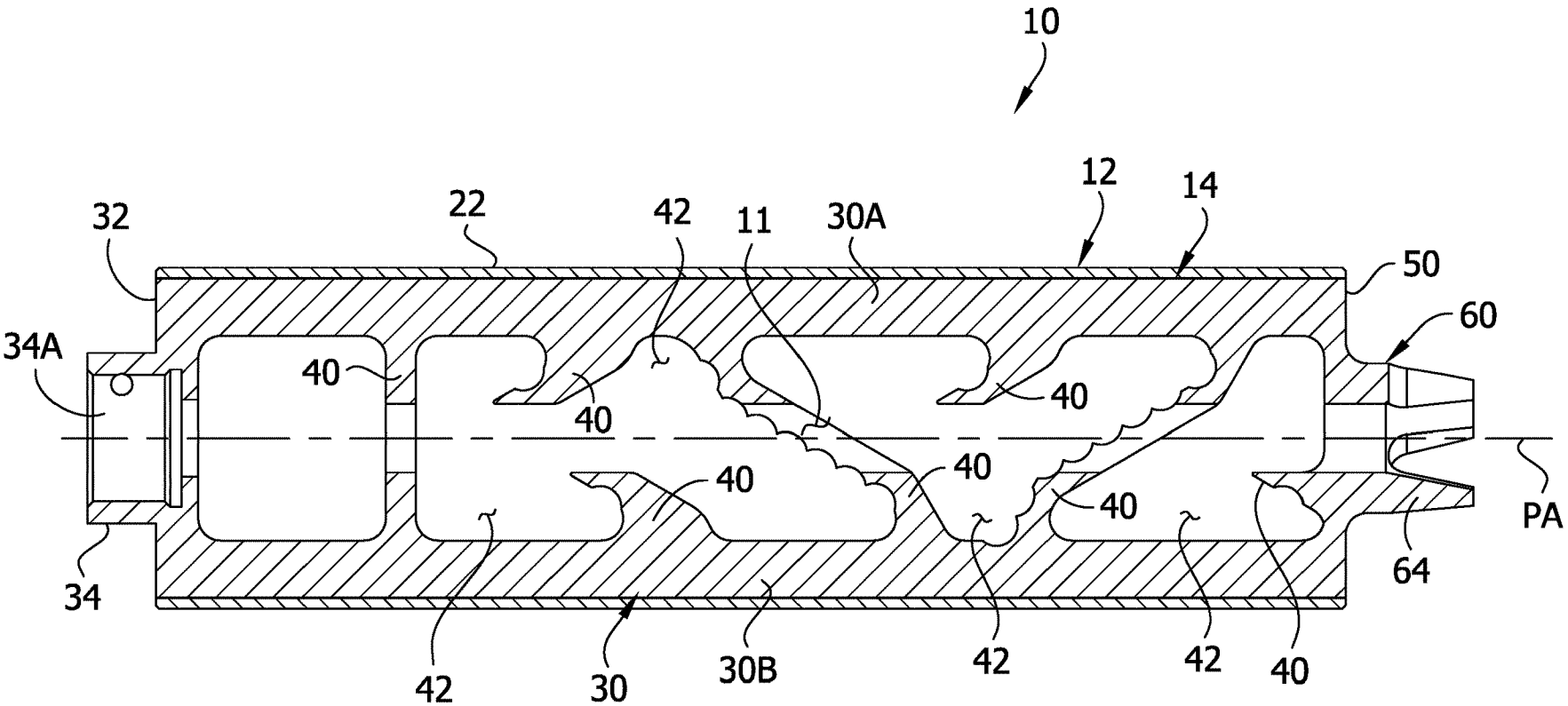
FIG. 3 is a section of the firearm sound suppressor taken in a plane including line 3-3 of FIG. 1.
Figure 4:
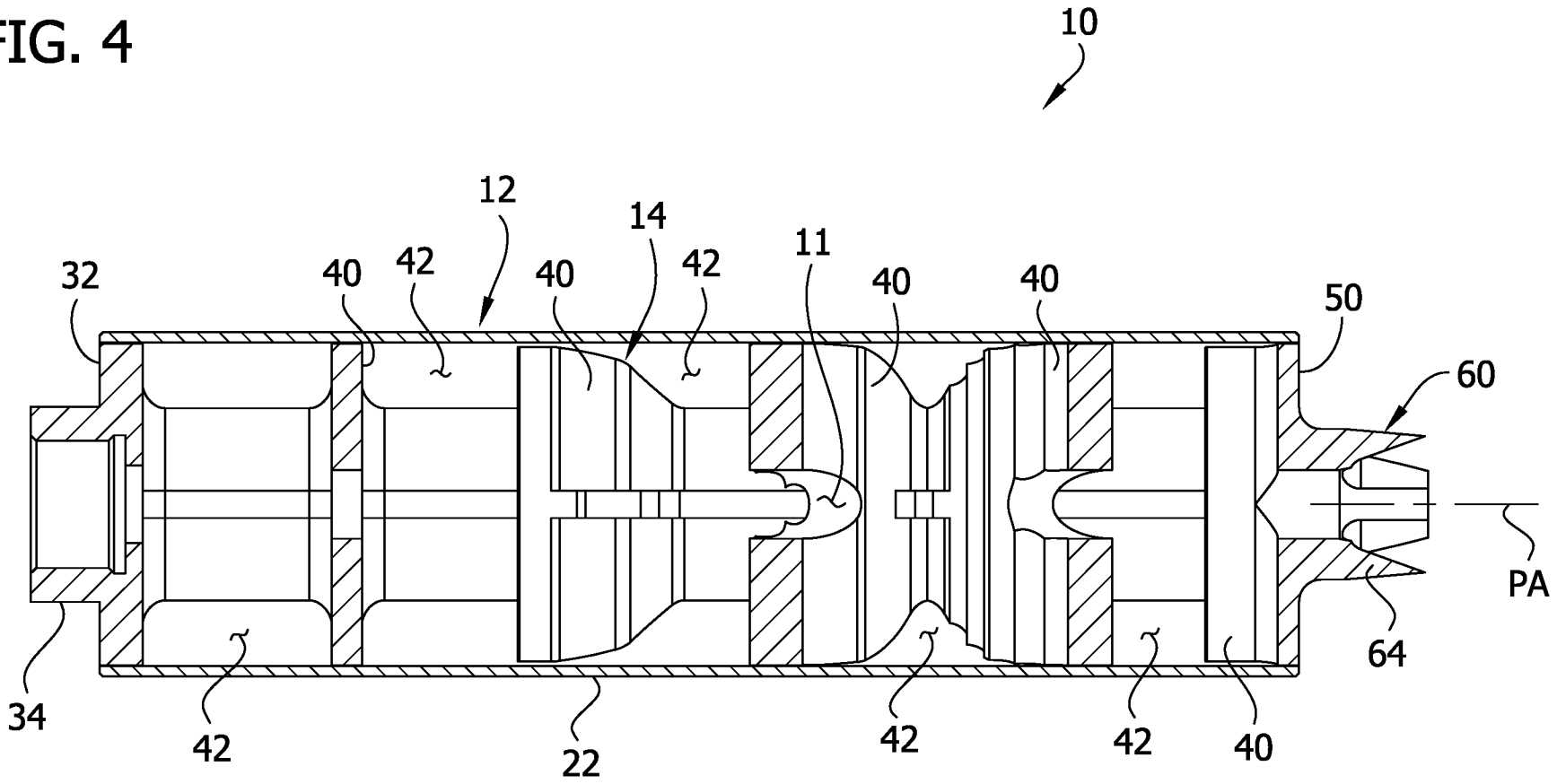
FIG. 4 is a section of the firearm sound suppressor taken in a plane including line 4-4 of FIG. 1.
Figure 5:
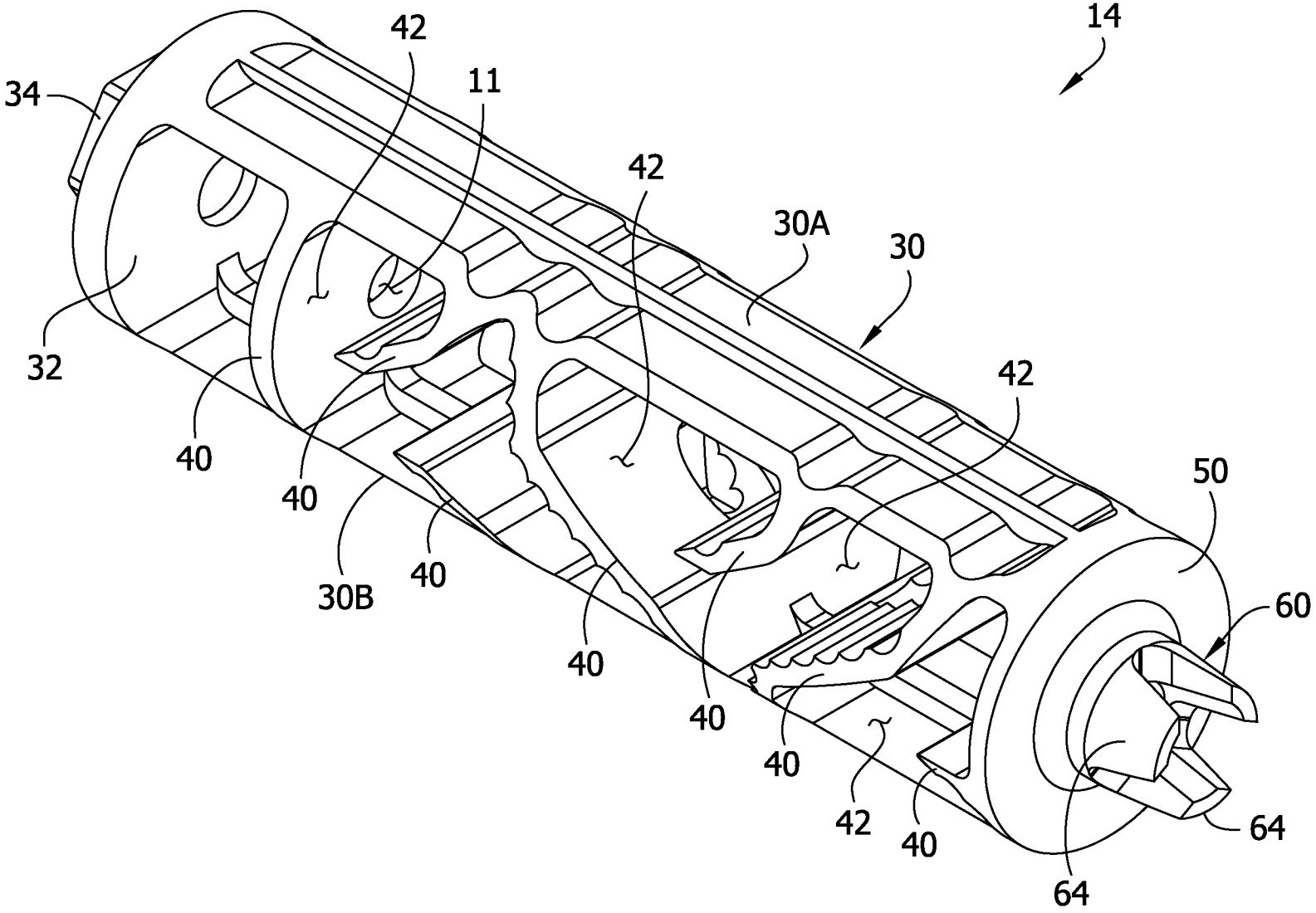
FIG. 5 is a perspective of a core of the firearm sound suppressor.
Figure 6:
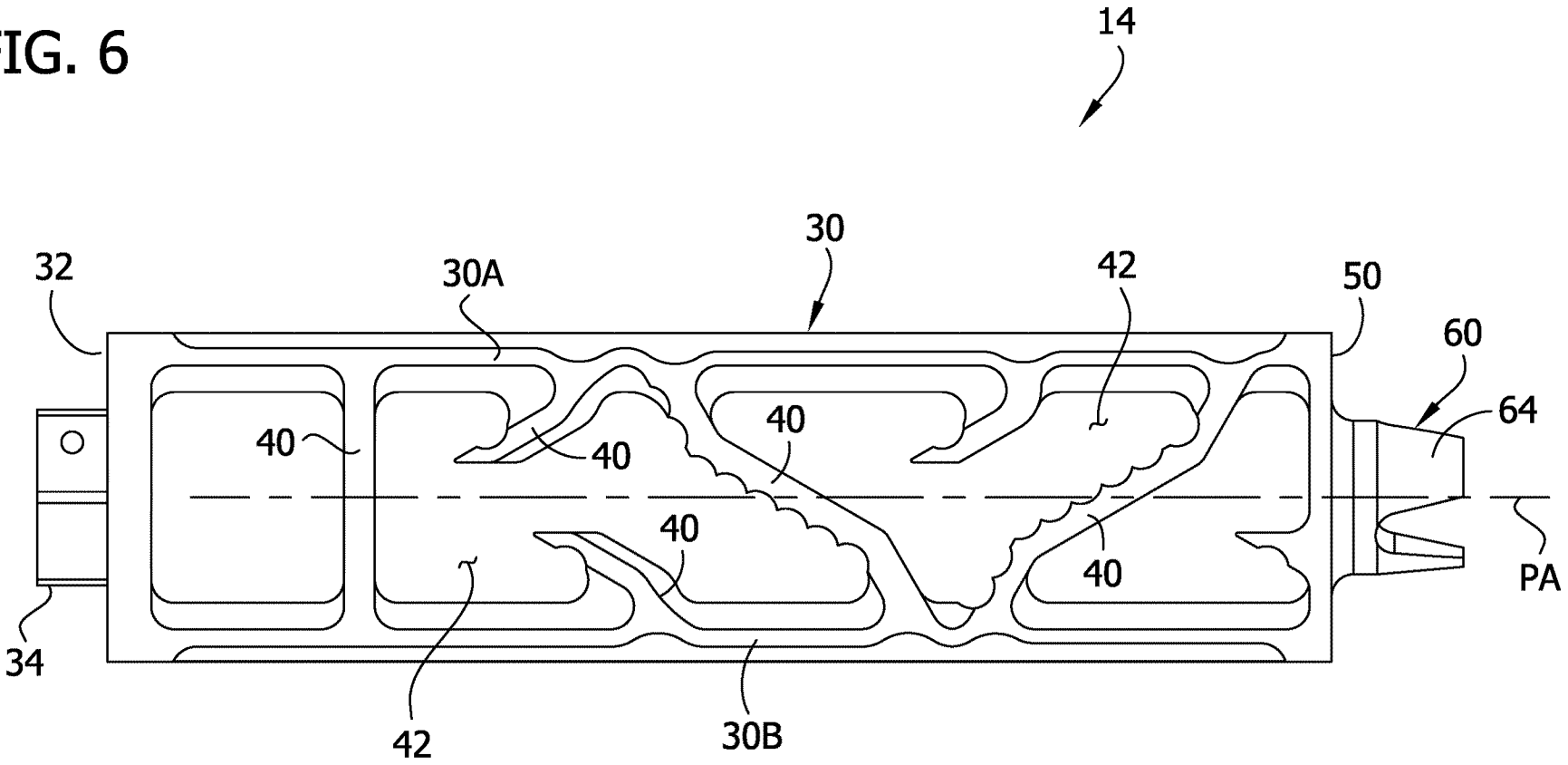
FIG. 6 is a side elevation of the core.

Referring to FIGS. 1-3, the suppressor 10 generally includes a housing 12, and a core 14 inside the housing. Persons having ordinary skill in the art may refer to the core as a "monocore" made by machining a blank of material to have the shape shown in FIGS. 5 and 6. It will be understood that the core 14, although illustrated as one piece of material, need not be a "monocore," and could comprise a plurality of separately formed pieces (e.g., including one or more baffle cups) assembled together.

The housing 12 includes a sleeve 22 having a generally cylindrical tubular shape. The sleeve 22 has opposite proximal and distal ends. In use, the proximal end would be adjacent the firearm, and the distal end would be located remotely from the firearm. The sleeve 22 can include a threaded opening (e.g., at the proximal end and/or distal end) configured to thread to an external thread on the core 14 for securing the housing in position on the core. The housing 12 can be secured to the core 14 in other ways without departing from the scope of the present invention. The housing 12 (and other components of the suppressor 10) can be made of aluminum or another suitable material. Housings having other configurations can be used without departing from the scope of the present invention.

The core 14 includes a frame 30 including upper and lower ribs 30A, 30B extending along the length of the core. A proximal end wall 32 is connected to the frame 30 and extends transversely with respect to the projectile axis PA. A firearm connector 34 is provided on the proximal end wall 32. The firearm connector 34 has a threaded opening 34A configured for threaded connection with a muzzle of a firearm for mounting the suppressor 10 on the firearm. It will be appreciated that the firearm connector 34 can be connected to a barrel adapter or other intermediate component for connection to the firearm barrel rather than being directly connected to the firearm barrel. Other types of firearm connectors (e.g., non-threaded, quick connect, etc.) can be used, and the firearm connector can be formed separately from the diffuser 14, without departing from the scope of the present invention. The firearm connector 34 is formed as one piece of material with the frame 30 but could be formed separately and attached to the frame and/or housing 12.

The core 14 includes a plurality of baffles 40 forming a tortuous gas flow path 42 through the core. A core similar to the core 14 and having baffles similar to the baffles 40 is described in detail in co-assigned U.S. Pat. No. 9,086,248, which is hereby incorporated by reference in its entirety. The baffles 40 can be referred to broadly as gas baffling. The baffles 40 have different configurations. One baffle 40 projects proximally from a distal end wall 50 of the core 14. This distal baffle 40 has a planar upper surface that is tangent to the projectile passage 11. It will be appreciated that other configurations and arrangements of baffles can be used within the scope of the present invention.

As will be understood by those having ordinary skill in the art, when a shot is fired through the suppressor 10, propellant gases passing through the suppressor 10 are baffled by the baffles 40 before exiting the distal end of the suppressor. As the gas travels along the tortuous gas flow path 42, the pressure and/or velocity of the gas reduces so that when the gas exits the suppressor 10 the pressure and/or velocity of the gas is less than when the gas exited the muzzle of the firearm. Accordingly, the suppressor 10 reduces the sound emitted when a shot is fired. Other arrangements of gas baffling and housings can be used without departing from the scope of the present invention.

The distal end wall 50 of the core 14 is connected to the frame 30 and projects radially inward from the ribs 30A, 30B toward to the projectile axis PA at the distal end of the suppressor 10. In the illustrated embodiment, the distal end wall 50 closes the distal end of the housing 12. The distal end wall 50 includes an opening 50A (FIG. 7) through which the projectile axis PA extends.

Figure 7:
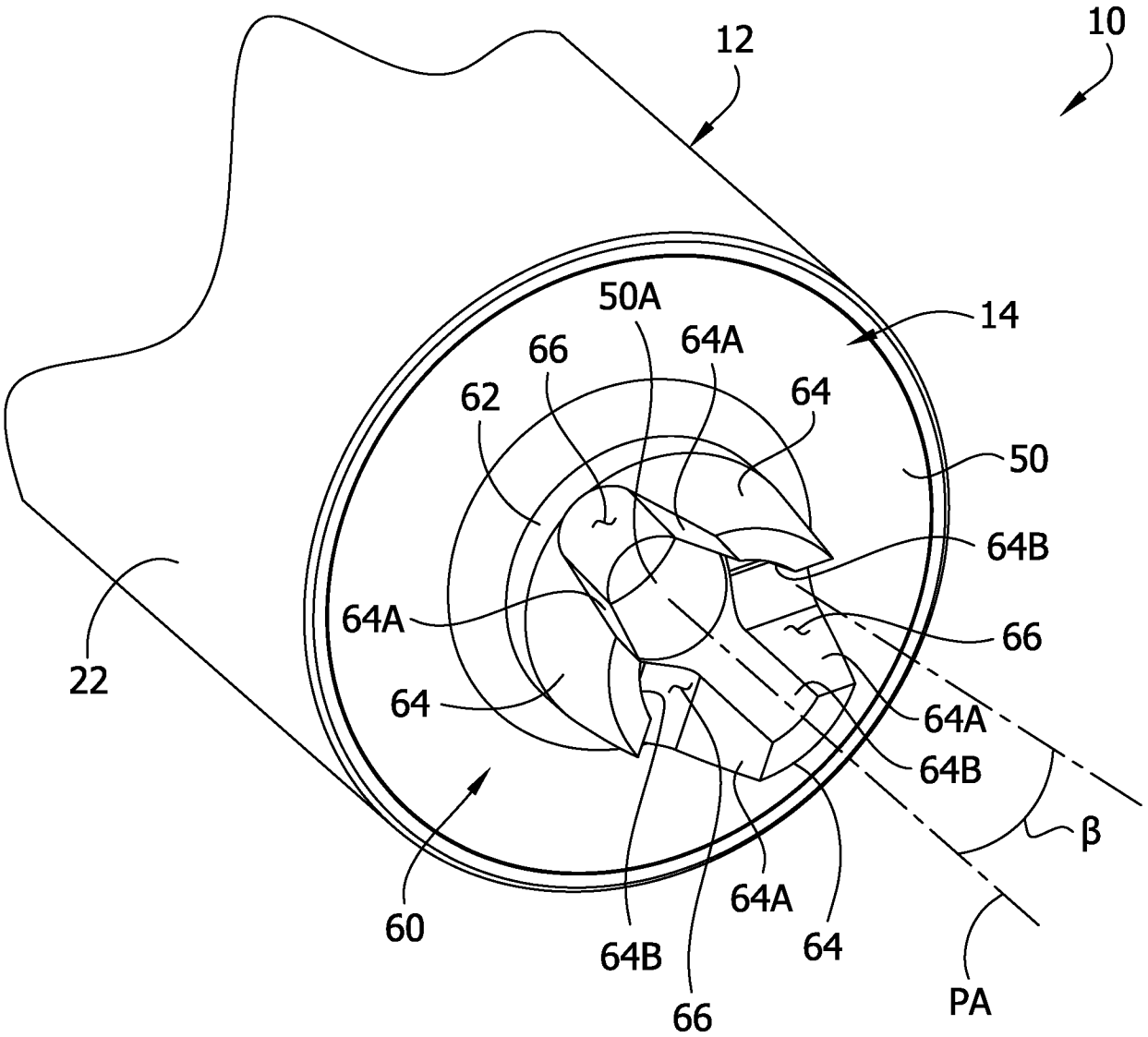
FIG. 7 is an enlarged fragmentary perspective of a distal end of the firearm sound suppressor.
Figure 8:
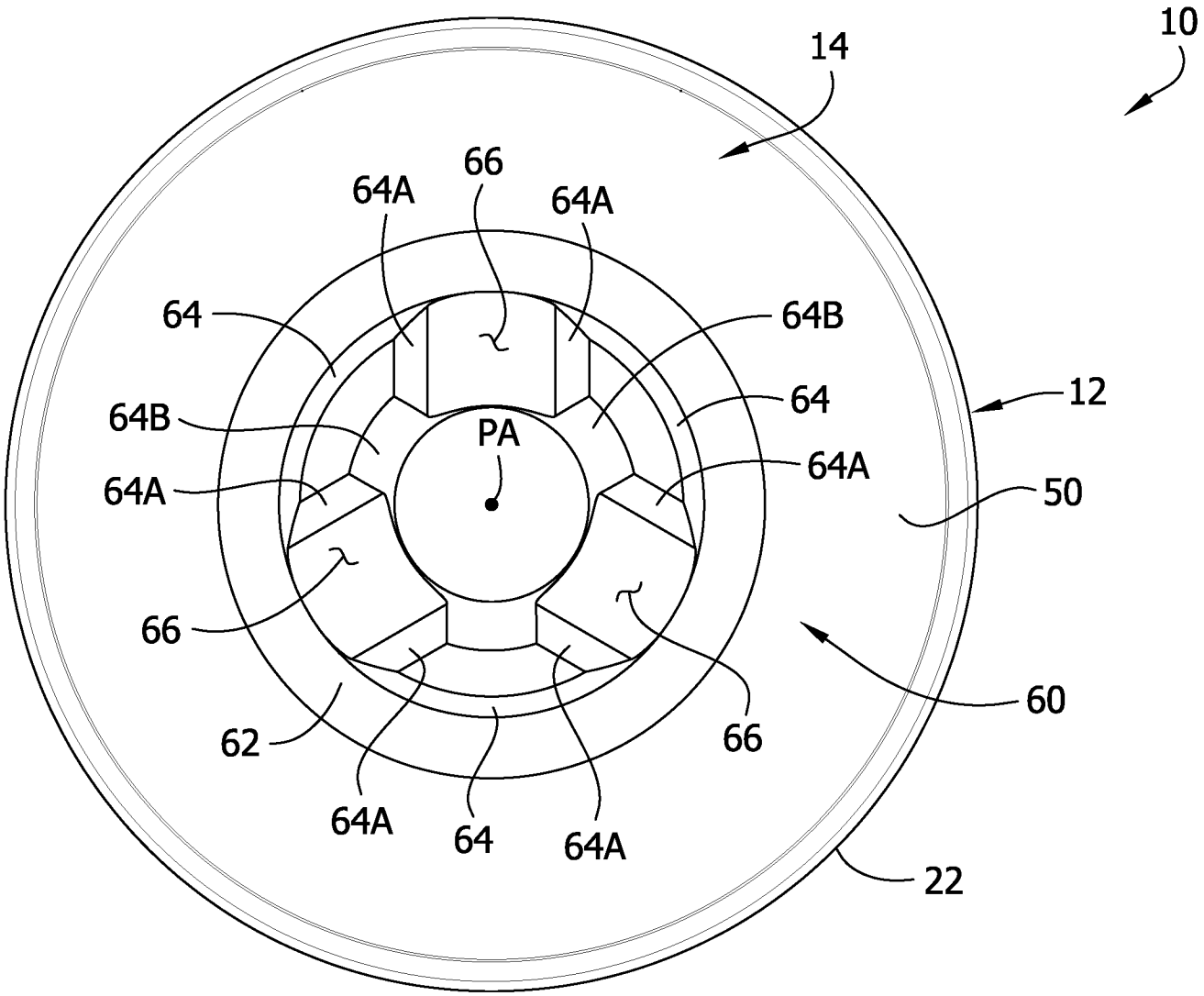
FIG. 8 is an enlarged distal end view of the firearm sound suppressor.
Figure 9:
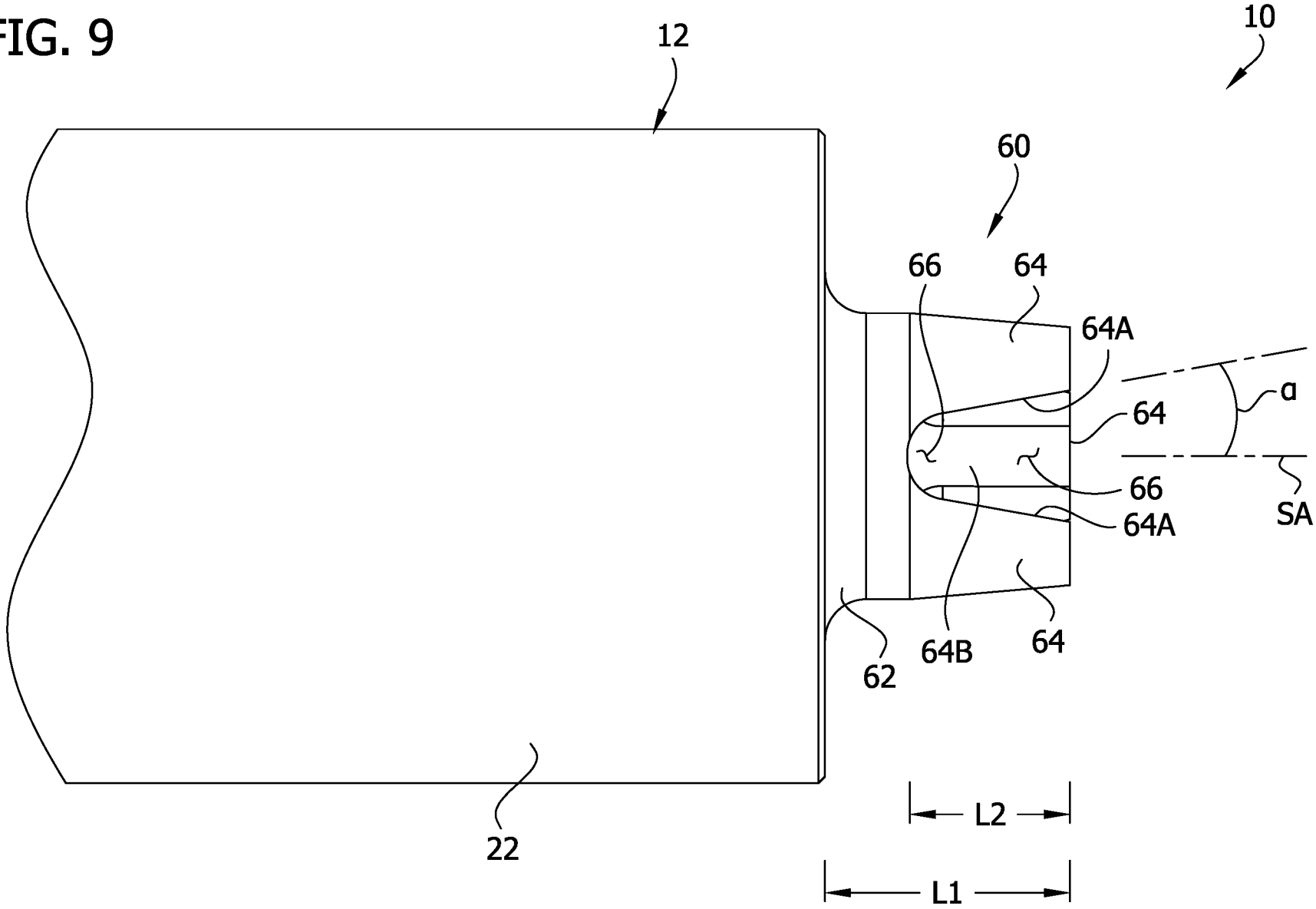
FIG. 9 is an enlarged fragmentary side elevation of the firearm sound suppressor.

Referring to FIGS. 7-9, a flash hider 60 is provided on the distal end wall 50 at the opening 50A of the distal end wall. The flash hider 60 is configured to reduce flash at the distal end of the suppressor 10 when a shot is fired. Such flash can be caused by secondary combustion when hot gas and/or products of combustion meet outside air at the distal end of the suppressor 10. The flash hider 60 is configured to facilitate cooling of the hot gas and/or products of combustion exiting the suppressor 10 to reduce flashing.

The flash hider 60 includes a collar 62 connected to the distal end wall 50 and a plurality of arms 64 extending distally away from the distal end wall. The collar 62 extends around a full circumference of the projectile passage 11. If desired, the collar 62 can be omitted. The arms 64 bound slots 66 between the arms. In the illustrated embodiment, there are three arms 64 and three slots 66 between respective arms. Other configurations of flash hiders can be used without departing from the scope of the present invention. In one example, the flash hider includes at least three arms and no more than seven arms.

The slots 66 are bounded on opposite sides by side surfaces 64A of respective arms 64. The side surfaces 64A of the arms 64 that bound a respective one of the slots diverge away from each other as the side surfaces extend distally away from the distal end wall 50. In the illustrated embodiment, the side surfaces 64A taper smoothly away from each other. Other configurations can be used without departing from the scope of the present invention. For example, the side surfaces 64A can be stepped to diverge away from each other as they extend distally away from the distal end wall 50.

Each slot 66 has a concave proximal end segment that is curved in the illustrated embodiment. Distally from the proximal end segments 66A, the side surfaces 64A of the arms that bound a respective one of the slots 66 smoothly taper away from each other. For example, the side surfaces can taper at an angle $\alpha$ (FIG. 9) in an inclusive range of between 5 and 20 degrees (e.g., about 11 degrees) with respect to a slot axis SA extending parallel to the projectile axis PA and intersecting the bottom middle of the slot. The arrangement is such that the slots 66 have a generally V shape with a curved base. The distally expanding gas flow area in the slots 66 facilitates cooling of the exiting gas to reduce flashing. The slots 66 have open distal ends at free ends of the arms 64. The arms 64 can be connected to each other distally from the distal ends of the slots 66 without departing from the scope of the present invention.

The arms 64 have inner surfaces 64B facing the projectile axis PA. The inner surfaces 64 diverge from the projectile axis PA as the inner surfaces extend distally. In the illustrated embodiment, the inner surfaces 64B taper smoothly away from projectile axis PA. For example, the inner surfaces can taper at an angle $\beta$ (FIG. 7) in an inclusive range of between 5 and 20 degrees (e.g., about 11 degrees) with respect to a slot axis SA extending parallel to the projectile axis PA. The arrangement is such that the gas flow path through the flash hider 60 inboard of the arms 64 and inboard of the slots 66 expands as it extends distally to facilitate cooling of the gas to reduce flashing.

As shown in FIG. 9, the flash hider 60 has a length L1 extending parallel to the projectile axis PA from the distal end wall 50 to a distal end of the flash hider. Each slot 66 has a length L2 extending parallel to the projectile axis PA from a proximal end of the slot to a distal end of the slot. Desirably, the lengths L2 of the slots 66 are at least one quarter of the length L1 of the flash hider 60, and more desirably the lengths of the slots are at least half of the length of the flash hider. The length L1 of the slots 66 assists in cooling the hot gas and/or products of combustion exiting the suppressor 10. It will be appreciated that the slots 66 can have other lengths, and ones of the slots can have different lengths than the other slots, without departing from the scope of the present invention.

As explained above, although the illustrated core 14 is comprises integrally formed components, it will be appreciated that the components can be formed separately and assembled to form the core without departing from the scope of the present invention. In the illustrated embodiment, the core 14 is machined from a blank of material (e.g., aluminum) to include the frame 30, the baffles 40, the proximal end wall 32, the firearm connector 34, the distal end wall 50, and the flash hider 60. However, the core 14 could be formed such that some but not all of the components of the core are formed as one piece of material. For example, the core 14 could be a single piece of material except for the flash hider 60, which could be formed separately and connected to the remainder of the core, such as by threaded connection to the distal end wall 50 (e.g., via a threaded opening in the end wall). Other constructions are possible. Moreover, the distal end wall 50 could be a part of the housing 12 rather than a part of the core 14 such that the flash hider is supported on the distal end wall of the housing.

In a method of using the suppressor 10, the user connects the suppressor to a firearm. When the user fires the firearm, the projectile travels through the projectile passage 11 along the projectile axis PA through the suppressor 10. Propellant gases also travel through the suppressor 10 along the projectile passage 11. The gas is baffled by the baffles 40 and travels along the tortuous gas flow path 42. The gas exits the suppressor 10 at lower velocity and with less pressure than when the gas entered the suppressor, and with reduced flashing because of the flash hider 60.

It will be apparent that modifications and variations are possible without departing from the scope of the invention defined in the appended claims.

As various changes could be made in the above constructions and methods without departing from the scope of the invention, it is intended that all matter contained in the above description and shown in the accompanying drawings shall be interpreted as illustrative and not in a limiting sense.

What is claimed is:

1. A firearm sound suppressor for use with a firearm, the firearm sound suppressor comprising:

a housing having a proximal end and a distal end opposite the proximal end, a core in the housing having a projectile passage through which a projectile can pass along a projectile axis, the core including a frame and a plurality of baffles defining a tortuous gas flow path through the core, the frame formed as one piece of material with the plurality of baffles, the core including a distal end wall at a distal end of the firearm sound suppressor, the distal end wall formed as one piece of material with the frame and the plurality of baffles, the core including a flash hider connected directly to the distal end wall and extending distally from the distal end wall.

2. A firearm sound suppressor as set forth in claim 1, wherein the flash hider includes a plurality of arms extending distally away from the distal end wall, the arms bounding slots between the arms.

3. A firearm sound suppressor as set forth in claim 2, wherein the flash hider has a length extending parallel to the projectile axis from the distal end wall to a distal end of the flash hider, each slot having a length extending parallel to the projectile axis from a proximal end of the slot to a distal end of the slot, the lengths of the slots being at least one quarter of the length of the flash hider.

4. A firearm sound suppressor as set forth in claim 3, wherein the lengths of the slots are at least half of the length of the flash hider.

5. A firearm sound suppressor as set forth in claim 2, wherein the flash hider includes at least three of said slots.

6. A firearm sound suppressor as set forth in claim 2, wherein the slots are bounded on opposite sides by side surfaces of respective arms, the side surfaces of the arms that bound a respective one of the slots diverging away from each other as the side surfaces extend distally away from the distal end wall.

7. A firearm sound suppressor as set forth in claim 2, wherein the slots include concave proximal end segments, and the side surfaces of the arms that bound a respective one of the slots diverge away from each other distally from the proximal end segments of the slots.

8. A firearm sound suppressor as set forth in claim 2, wherein the slots have open distal ends at free ends of the arms.

9. A firearm sound suppressor as set forth in claim 2, wherein the arms have inner surfaces facing the projectile axis, the inner surfaces diverging from the projectile axis as the inner surfaces extend distally.

10. A firearm sound suppressor as set forth in claim 2, wherein the flash hider includes a collar extending circumferentially around the projectile passage, the collar connected to the distal end wall, the arms extending distally from the collar.

11. A firearm sound suppressor as set forth in claim 1, wherein the flash hider is formed as one piece of material with the distal end wall.

12. A firearm sound suppressor for use with a firearm, the firearm sound suppressor comprising:

a firearm connector constructed for connecting the firearm sound suppressor to the firearm;

a housing supported by the firearm connector, the housing having a proximal end and a distal end opposite the proximal end;

a projectile passage extending between the proximal and distal ends of the housing through which a projectile can pass along a projectile axis through the firearm suppressor;

gas baffling supported by the housing, the gas baffling forming a tortuous gas flow path inside the housing;

the gas baffling including a distal end wall formed separately from the housing and located adjacent an open distal end of the housing at a distal end of the firearm sound suppressor, the distal end wall having an opening through which the projectile passage extends; and a flash hider connected directly to and extending distally from the distal end wall, the flash hider including a plurality of arms extending distally away from the distal end wall, the arms bounding slots between the arms, the flash hider having a length extending parallel to the projectile axis from the distal end wall to a distal end of the flash hider, each slot having a length extending parallel to the projectile axis from a proximal end of the slot to a distal end of the slot, the lengths of the slots being at least one quarter of the length of the flash hider.

13. A firearm sound suppressor as set forth in claim 12, wherein the lengths of the slots are at least half of the length of the flash hider.

14. A firearm sound suppressor as set forth in claim 13, wherein the flash hider includes at least three of said slots.

15. A firearm sound suppressor as set forth in claim 12, wherein the slots are bounded on opposite sides by side surfaces of respective arms, the side surfaces of the arms that bound a respective one of the slots diverging away from each other as the side surfaces extend distally away from the distal end wall.

16. A firearm sound suppressor as set forth in claim 15, wherein the slots include concave proximal end segments, and the side surfaces of the arms that bound a respective one of the slots diverge away from each other distally from the proximal end segments of the slots.

17. A firearm sound suppressor as set forth in claim 12, wherein the slots have open distal ends at free ends of the arms.

18. A firearm sound suppressor as set forth in claim 12, wherein the arms have inner surfaces facing the projectile axis, the inner surfaces diverging from the projectile axis as the inner surfaces extend distally.

19. A firearm sound suppressor as set forth in claim 12, wherein the flash hider includes a collar extending circumferentially around the projectile passage, the collar connected to the distal end wall, the arms extending distally from the collar.

20. A firearm sound suppressor as set forth in claim 12, wherein the flash hider is formed as one piece of material with the distal end wall.

21. A firearm sound suppressor as set forth in claim 1, wherein the distal end of the housing includes an opening out of which the core protrudes, the flash hider extending distally beyond the opening.

22. A firearm sound suppressor as set forth in claim 12, wherein the flash hider extends from the distal end wall distally beyond the distal end of the housing.

23. A firearm sound suppressor for use with a firearm, the firearm sound suppressor comprising:

a firearm connector constructed for connecting the firearm sound suppressor to the firearm;

a housing supported by the firearm connector, the housing having a proximal end and a distal end opposite the proximal end, the distal end having an opening;

a projectile passage extending between the proximal and distal ends of the housing through which a projectile can pass along a projectile axis through the firearm suppressor;

gas baffling supported by the housing, the gas baffling forming a tortuous gas flow path inside the housing;

the gas baffling including a distal end wall formed separately from the housing and located adjacent the distal end opening of the housing at a distal end of the firearm sound suppressor; and a flash hider supported by and extending distally from the distal end wall, the flash hider including a plurality of arms extending distally away from the distal end wall, the arms bounding slots between the arms, the flash hider having a length extending parallel to the projectile axis from the distal end wall to a distal end of the flash hider, each slot having a length extending parallel to the projectile axis from a proximal end of the slot to a distal end of the slot, the lengths of the slots being at least one quarter of the length of the flash hider, at least one of the gas baffling and the flash hider extending from within the housing through the distal end opening of the housing.

* * * * *